US005671464A

United States Patent [19]

Kubota

[11] Patent Number: 5,671,464

[45] Date of Patent: Sep. 23, 1997

[54] COLOR IMAGE FORMING APPARATUS USING INTERMEDIATE TRANSFER MEMBER

[75] Inventor: Akira Kubota, Nagano, Japan

[73] Assignee: Seiko Epson Corporation, Tokyo, Japan

[21] Appl. No.: 664,618

[22] Filed: Jun. 18, 1996

[30] Foreign Application Priority Data

Jun. 27, 1995 [JP] Japan ..... 7-160553
Apr. 23, 1996 [JP] Japan ..... 8-101754

[51] Int. Cl.[6] ..... G03G 15/16

[52] U.S. Cl. ..... 399/101; 399/302

[58] Field of Search ..... 399/302, 308, 399/309, 101

[56] References Cited

U.S. PATENT DOCUMENTS

| | | | |
|---|---|---|---|
| 3,838,919 | 10/1974 | Takahashi . | |
| 4,931,839 | 6/1990 | Tompkins et al. | 399/66 |
| 5,084,735 | 1/1992 | Rimai et al. | 399/302 |
| 5,099,286 | 3/1992 | Nishise et al. | 399/302 |
| 5,173,735 | 12/1992 | Kusumoto | 399/302 |
| 5,237,374 | 8/1993 | Ueno et al. | 399/350 |
| 5,291,252 | 3/1994 | Kawaishi . | |
| 5,376,999 | 12/1994 | Hwang . | |

FOREIGN PATENT DOCUMENTS 7-77880 3/1995 Japan .

*Primary Examiner*—Robert Beatty
*Attorney, Agent, or Firm*—Sughrue, Mion, Zinn, Macpeak & Seas, PLLC

[57] ABSTRACT

To provide a color image forming apparatus that can implement high speed printing and produce high quality images free from displacements caused when color toner images are superimposed one upon another. A color image forming apparatus using an intermediate transfer belt 106. The apparatus is constructed so that a cleaning blade 1191 and a drive roller 115 are arranged so as to confront the intermediate transfer belt 106 in order that a displacement caused when one color toner image is superimposed upon another can be controlled within a single image-recording dot during a primary transfer process. The apparatus is constructed such that $la/l < ld \cdot E \cdot t/(L0 \cdot \mu \cdot n)$, where la (m) is the length of the intermediate transfer belt from a drive roller to a cleaning device, l (m) is the total length of the transfer belt, ld (m) is a pitch between dots developed on the latent image carrying body, E (kg/m$^2$) is the Young's modulus of the transfer belt, t (m) is the thickness of the belt, L0 (m) is the length of a recording medium, μ is the frictional coefficient between the cleaning device and the transfer belt, and n (kg/m) is the line pressure of the cleaning means in contact with the transfer belt.

5 Claims, 3 Drawing Sheets

COLOR IMAGE FORMING APPARATUS USING INTERMEDIATE TRANSFER MEMBER

BACKGROUND OF THE INVENTION

1. Field of the Invention

The invention relates to an electrophotographic color image forming apparatus for use in color coping machines, printers, facsimiles, and other apparatuses.

2. Related Art

A color image forming apparatus such as described below has heretofore been known as disclosed in U.S. Pat. No. 3,838,919. The color image forming apparatus includes: a first transfer means that sequentially transfers toner images developed on an image carrying body to an intermediate transfer body; a second transfer means that collectively transfers the toner images superimposed on an intermediate transfer body onto a recording medium; and a cleaning means such as a cleaning blade that removes a toner remaining on the intermediate transfer body. Further, it is known to use as the intermediate transfer body either a beltlike member which has a predetermined electric resistance and which is stretched by a group of rollers including a drive roller from inside, or a hard roller that has an electric resistance layer over the surface of a metal base.

In such image forming apparatus, after the collective transfer of the toner images onto the recording medium from the intermediate transfer body by the second transfer means (hereinafter referred to as the "secondary transfer process"), the cleaning blade comes in contact with the intermediate transfer body, and it is before the formation of the first-color toner image of a next print image that the cleaning blade moves away from the intermediate transfer body. Still further, in order to sequentially transfer the toner images from the image carrying body to the intermediate transfer body by the first transfer means (hereinafter referred to as the "primary transfer process"), a technique disclosed in Unexamined Japanese Patent Publication No. Hei. 7-77880 has been employed. This technique is designed to bring the cleaning blade into contact with the intermediate transfer body after all the color toner images to be superimposed have been transferred thereto.

However, in the above-identified conventional example in which the cleaning blade is not only brought into contact with the intermediate transfer body after the second transfer process has been completed, but also moved away from the intermediate transfer body before the first-color toner image of a next print image is formed, as well as in the conventional example disclosed in Unexamined Japanese Patent Publication No. Hei. 7-77880, the primary transfer process must not be performed while the cleaning blade is in contact with the intermediate transfer body. That is, it is necessary to suspend the primary transfer process of the first-color toner image of a next print image while the last-color toner image is moving along the intermediate transfer body by at least a distance two times or more the circumferential length of a maximum print image from the start of the primary transfer process of such last-color toner image of the previous print image in a constant-speed continuous printing operation. This has imposed the problem of reducing the print speed. Also known is a technique of switching the process speed while the primary or the secondary transfer process is not being performed in order to improve the print speed. However, this technique makes the apparatus large in structure and elevates the cost of manufacture. Still further, even if a high speed process is introduced, there have been image defects attributable to fluctuations in loads applied to the intermediate transfer belt, such as displacements caused when one color toner image is superimposed upon another at the time of primary transfer process.

SUMMARY OF THE INVENTION

The invention has been made in view of the aforementioned conventional problems. The object of the invention is, therefore, to provide a color image forming apparatus that can produce a high quality image while improving the print speed and downsizing the structure of the apparatus.

To achieve the above object, a first aspect of the invention is applied to a color image forming apparatus that includes: a first transfer means for sequentially transferring a plurality of toner images developed on a latent image carrying body onto an intermediate transfer belt stretched by a group of support rollers including a drive roller; a second transfer means for collectively transferring the toner images superimposed on the intermediate transfer belt onto a recording medium; and a cleaning means for removing a toner remaining on the intermediate transfer belt. In such color image forming apparatus, if it is assumed that:

- a total circumferential length of the intermediate transfer belt as stretched is l (m);
- a Young's modulus and a thickness of the intermediate transfer belt are E (kg/m$^2$) and t (m), respectively;
- a frictional coefficient between the cleaning means and the intermediate transfer belt is μ;
- a line pressure of a contact load brought about by the cleaning means coming in contact with the intermediate transfer belt is n (kg/m);
- a circumferential length of the recording medium is L0 (m); and
- a pitch between dots developed on the latent image carrying body is ld (m);

then, a ratio (la/l) of a length la (m) to the total circumferential length of the intermediate transfer belt is expressed as follows, the length la extending from a central position of an angle at which the intermediate transfer belt is wrapped around the drive roller to a contact position at which the cleaning means is in contact with the intermediate transfer belt in an intermediate transfer belt rotating direction:

$$la/l<ld\cdot E\cdot t/(L0\cdot\mu\cdot n).$$

A second aspect of the invention is applied to a color image forming apparatus according to the first aspect of the invention, such color image forming apparatus being characterized in that a tensile load s0 (kg/m) per unit length of the intermediate transfer belt given by the group of support rollers including the drive roller while the cleaning means is away from the intermediate transfer belt is expressed as follows:

$$s0>\mu\cdot n-ld\cdot E\cdot/L0.$$

A third aspect of the invention is applied to a color image forming apparatus according to the first aspect of the invention, such color image forming apparatus being characterized in that a first-color toner image is being transferred onto the intermediate transfer belt while the cleaning means is in contact with the intermediate transfer belt, and moves away from the intermediate transfer belt before a second-color toner image is transferred.

A fourth aspect of the invention is applied to a color image forming apparatus according to the first aspect of the invention, such color image forming apparatus being characterized in that a last-color toner image is being transferred onto the intermediate transfer belt while the cleaning means is in contact with the intermediate transfer belt.

Strains in the intermediate transfer belt caused by load fluctuations of the intermediate transfer belt as a result of the cleaning means coming in contact with or moving away from the belt are reduced, so that displacements between toner images can be controlled within a single image-recording dot when one color toner image is superimposed upon another in the primary transfer process.

Further, the belt does not slip due to the cleaning means coming in contact therewith or moving away therefrom, so that displacements between toner images can be controlled within a single image-recording dot when one color toner image is superimposed upon another in the primary transfer process.

DETAILED DESCRIPTION OF THE PREFERRED EMBODIMENTS

Figure 1:
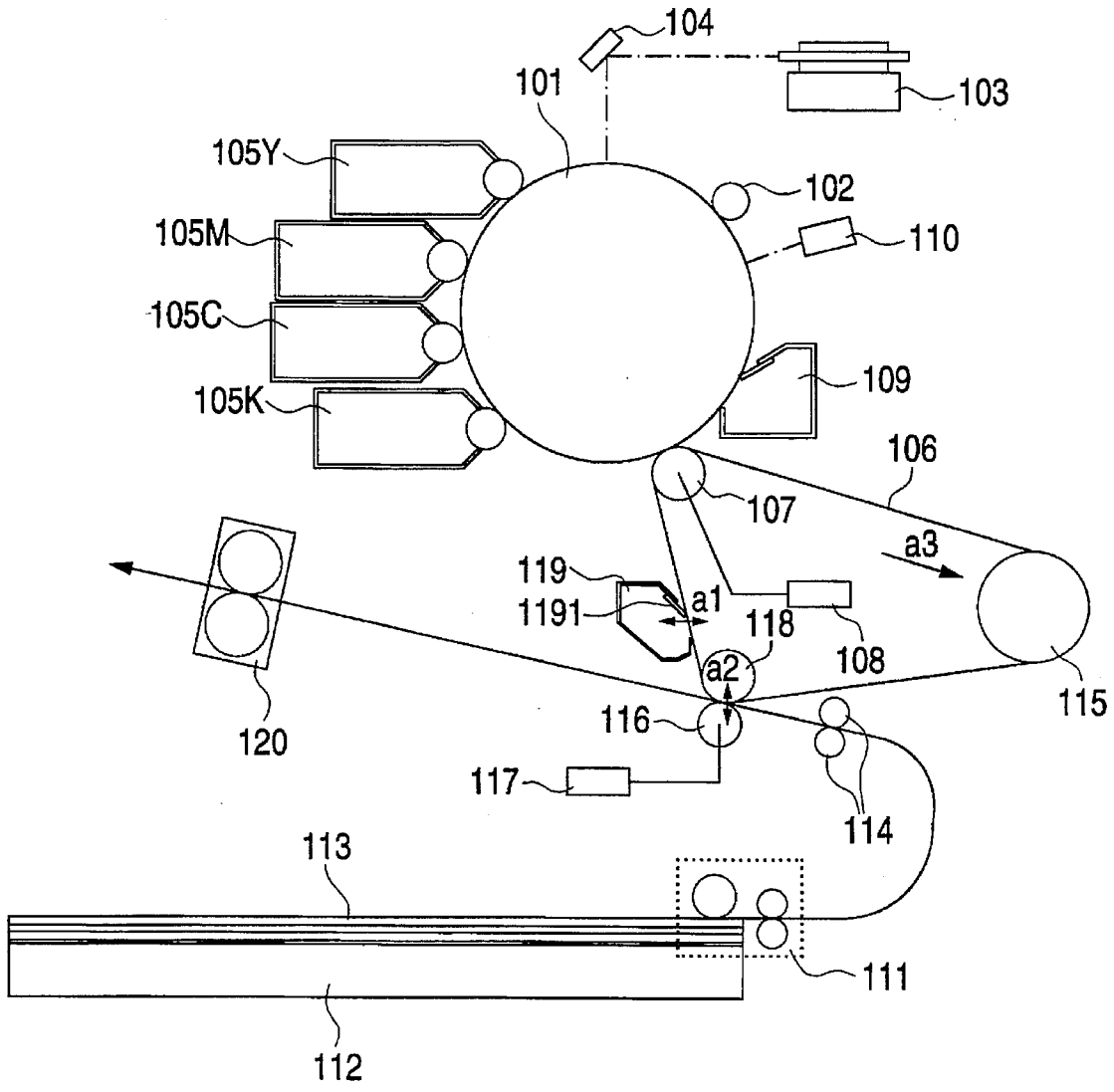
FIG. 1 is a schematic diagram showing a color image forming apparatus, which is an embodiment of the invention, in cross section.

FIG. 1 is a schematic diagram showing a color image forming apparatus, which is an embodiment of the invention, in cross section.

An operation of the apparatus will be described first. A charge roller 102 uniformly charges a photoreceptor 101 to a certain potential. A laser beam is introduced onto the photoreceptor 101 through a reflecting mirror 104 by an exposing means 103 that is a laser scanning optical system, so that a latent electrostatic image is formed on the photoreceptor 101. Then, retractable, monocomponent-toner and contact type developing units 105 are operated in the following way. A yellow developing unit 105Y is caused to come in contact with the photoreceptor 101 with other developing units being moved away, and a negatively statically chargeable yellow toner is reversely processed by the action of an electric field produced by a not shown power supply. The thus reversely processed image is rendered into a real image on the photoreceptor 101. The yellow toner that has been rendered into a real image is thereafter transferred onto an intermediate transfer belt 106 with a bias voltage whose polarity is opposite to that of the toner being applied to a primary transfer roller 107 from a primary transfer power supply 108 and further through the action of an electric field that is produced by such application of the bias voltage. The intermediate transfer belt 106 is formed, e.g., by dispersing carbon into a binder resin. The toner that remains on the photoreceptor 101 after the transfer operation has been completed is recovered by a photoreceptor cleaner 109 that causes an elastomer resin to come in contact with the remaining toner, and the photoreceptor potential is then reset by a static eliminator lamp 110. The same operation is repeated for a magenta developing unit 105M, a cyan developing unit 105C, and a black developing unit 105K so as to synchronize with predetermined intermediate transfer belt 106 positions and exposing timings of the exposing means 103. As a result, the respective color toner images are superimposed one upon another on the intermediate transfer belt 106 to form a full-color image. On the other hand, a recording medium 113 is forwarded from a sheet feed cassette 112 to a pair of resist rollers 114 by a sheet feed means 111 and is thereafter forwarded to a secondary transfer section in synchronism with the full-color image on the intermediate transfer belt 106. The secondary transfer section is formed of a secondary transfer roller 116 that is retractable in directions indicated by arrows a2 in FIG. 1. At the secondary transfer section, not only the secondary transfer roller 116 forms a nipping section by coming in contact with the intermediate transfer belt 106 in synchronism with the recording medium 113, but also a full-color toner image is formed on the recording medium 113 with a bias voltage whose polarity is opposite to that of the toner being applied from a secondary transfer power supply 117 and further through the action of an electric field produced by such application of the bias voltage. The recording medium 113 is thereafter fixed by a fixing means 120 and then discharged out of the apparatus. The toner that still remains on the belt after the secondary transfer process has been completed is recovered by an intermediate transfer body cleaner 119 that is retractable in directions indicated by arrows a1 in FIG. 1. The secondary transfer roller 116 and the intermediate transfer body cleaner 119 must be retracted from the intermediate transfer belt 106 so that the toner images forwarded onto the intermediate transfer belt 106 will not be disturbed for a period in which the four color toner images are being superimposed one upon another in the primary transfer process.

The conditions that various parts of the color image forming apparatus must satisfy in order to implement high speed and high quality printing will be described by taking the aforementioned construction as an example.

The invention, using a beltlike member as the intermediate transfer body, attempts to find a satisfactory range of parameters regarding the construction and components for controlling transfer displacements between the respective color toner images (hereinafter referred to as the "transfer displacement" where applicable), the transfer displacements being caused by the elongation of a member that must be taken into consideration when high speed printing is effected.

Figure 2:
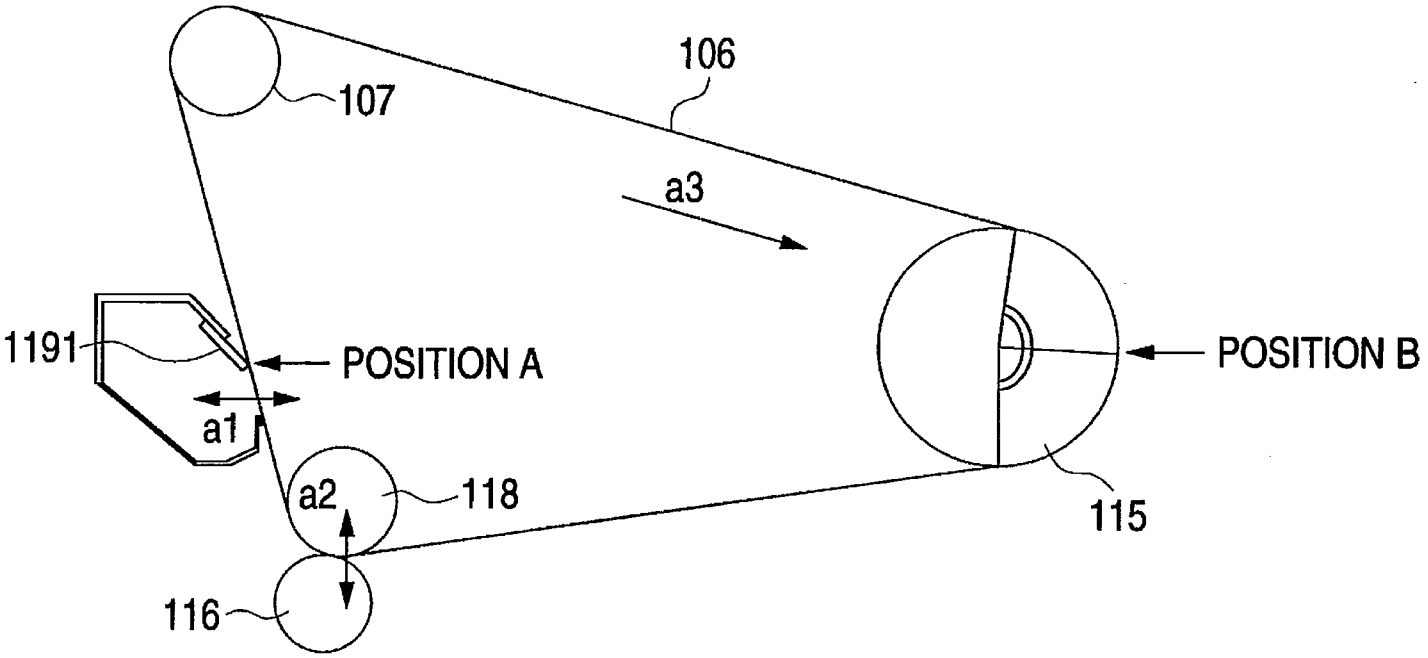
FIG. 2 is an enlarged view showing the neighborhood of an intermediate transfer belt in FIG. 1.

FIG. 2 shows an intermediate transfer unit including the intermediate transfer belt 106 and a drive roller 115 of FIG. 1 in enlarged form. The intermediate transfer belt 106 is stretched by a group of rollers including the drive roller 115 at a predetermined tension. The intermediate transfer belt 106 is also driven to rotate by a frictional force of the drive roller 115. The group of other rollers supporting the intermediate transfer belt 106 from the back surface thereof, as well as the photoreceptor 101 that comes in contact with the belt on the image carrying surface thereof, the secondary transfer roller 116, or the recording medium 113 biased onto the secondary transfer roller 116, and a cleaning blade 1191 give a load to the rotation of the intermediate transfer belt 106. The cleaning blade 1191 is a cleaning means included in the intermediate transfer body cleaner 119. As a result of this load, the intermediate transfer belt 106 is deformed, but since the members other than the cleaning blade 1191 are idly driven by the intermediate transfer belt 106, the degree of load is negligible when compared with a load given to the belt 106 by the cleaning blade 1191 coming in contact with the belt.

Thus, it is necessary to consider an image defect, such as transfer displacement, attributable to strain of the intermediate transfer belt 106 caused by the cleaning blade 1191 coming in contact with the belt 106. Since the cleaning blade 1191 moves away from or comes in contact with the intermediate transfer belt 106, the tension of the intermediate transfer belt 106 is not always constant, which also means that the degree of strain of the intermediate transfer belt 106 is not constant, either. The effects of the deformation of the intermediate transfer belt 106 upon a printed image are discussed below.

In FIG. 2, let it be assumed that the length of the intermediate transfer belt 106 is l (m); the thickness thereof is t (m); and the Young's modulus is E (kg/m$^2$). The position A is a position at which the cleaning blade 1191 comes in contact with the intermediate transfer belt 106, and the position B is the center of an intermediate transfer belt 106 portion that is in contact with the drive roller 115. It is also assumed that the length of the belt from the position A to the position B in an intermediate transfer belt 106 rotating direction, which is a direction indicated by an arrow a3 in FIG. 2, (hereinafter referred to as the "tense side") is lb (m); and that the length of the belt from the position B to the position A (hereinafter referred to as the "loose side") is la (m). As described below, since the fluctuation of the tension at the primary transfer position is considered, it does not need to account the continuous shift of the tension within the intermediate belt portion that is in contact with the drive roller. So, let σ1 (kg/m) and σ2 (kg/m) be set as approximations good enough to calculate the quantity of strain of the intermediate transfer belt 106 at the primary transfer position under the assumption that the tension per unit length in the axial direction throughout the total length including the tense side and the loose side while the cleaning blade 1191 is in contact with the intermediate transfer belt 106 is constant. Further, let σ0 (kg/m) be set as an approximation under the assumption that the tension per unit length in the axial length throughout the total length while the cleaning blade 1191 is away from the intermediate transfer belt 106 is constant. Still further, it is assumed that the frictional coefficient between the cleaning blade 1191 and the intermediate transfer belt 106 is μ; and that the contact load per unit length in the axial direction is n (kg/m).

Since the load other than that applied by the cleaning blade 1191 is negligible as described above, the aforementioned parameters can be related as follows.

$$\sigma 1-\sigma 2=\mu\cdot n \qquad \text{Eq. (1)}$$

Further, σ0, σ1, and σ2 can be related approximately as follows.

$$\sigma 0=(1b\cdot\sigma 1+1a\cdot\sigma 2)/l \qquad \text{Eq. (2)}$$

From Eqs. (1) and (2), σ1 and σ2 are expressed as follows.

$$\sigma 1=(l\cdot\sigma 0+la\cdot\mu\cdot n)/l \qquad \text{Eq. (3)}$$

$$\sigma 2(l\cdot\sigma 0-lb\cdot\mu\cdot n)/l \qquad \text{Eq. (4)}$$

As a result, increments of strain in the circumferential direction of the intermediate transfer belt 106 between the condition in which the cleaning blade 1191 is away from the intermediate transfer belt 106 and the condition in which the cleaning blade 1191 is in contact with the intermediate transfer belt 106 are obtained as follows.

$$\epsilon 1=la\cdot\mu\cdot n/(E\cdot t\cdot l) \qquad \text{Eq. (5)}$$

$$\epsilon 2=-lb\cdot\mu\cdot n/(E\cdot t\cdot l) \qquad \text{Eq. (6)}$$

where ε1 is the increment of strain on the tense side, and ε2 is the increment of strain on the loose side. In the case where a tension and the quantity of strain caused by such tension differ from one part to another over the intermediate transfer belt 106, there are speed differences. It is assumed that the belt travel speed while the cleaning blade 1191 is away from the intermediate transfer belt 106 is V (m/s), then belt travel speeds V1 (m/s) and V2 (m/s) on both the tense side and the loose side while the cleaning blade 1191 is in contact with the intermediate transfer belt 106 are expressed as follows.

$$V1=V \qquad \text{Eq. (7)}$$

$$V2=V\cdot(l-\epsilon 2)/(l+\epsilon 1) \qquad \text{Eq. (8)}$$

Eq. (7) indicates that there is no slippage between the drive roller 115 and the intermediate transfer belt 106.

In order to improve the print speed for continuous printing, let us think about a case where the cleaning blade is in contact with the intermediate transfer belt 106 when toner images are superimposed one upon another sequentially in a primary transfer process. More specifically, there can be two cases: a case where the cleaning blade is in contact with the intermediate transfer belt while the last-color toner image (of a print image) to be superimposed is being subjected to a primary transfer process; and a case where the cleaning blade is brought into contact with the intermediate transfer belt after the primary transfer process of the last-color toner image has been completed and a primary transfer process is started for the first-color toner image (of a next print image) with the cleaning blade remaining in contact with the intermediate transfer belt. In these cases, such strains as expressed in Eqs. (5) and (6) due to the load applied by the cleaning blade coming in contact with the intermediate transfer belt are caused. As a result of these strains, displacement occurs between a toner image subjected to the primary transfer process while the cleaning blade is in contact with the intermediate transfer belt and a toner image subjected to the primary transfer process while the cleaning blade is away from the intermediate transfer belt. Displacements between the toner images during primary transfer processes will be evaluated in the following four cases (I) to (IV).

It may be noted that the primary transfer processes are performed on the tense side since the intermediate transfer unit shown in FIG. 2 has the primary transfer position (i.e., the central belt stretching position B on the drive roller 115), and the cleaning blade 1191 contact position A arranged in this order in the intermediate transfer belt 106 rotating direction. However, there is another arrangement, in which the primary transfer position, the cleaning blade contact position, and the central belt stretching position on the drive roller may be arranged in this order in the intermediate transfer belt rotating direction. In this case, the primary transfer position is located on the loose side. Thus, the problem of displacement between the toner images in the primary transfer processes must be considered for a total of four cases. These four cases comprise all combinations of such factors as whether the primary transfer position is on the tense side or on the loose side, and whether the toner image to be subjected to a primary transfer process while the cleaning means is in contact with the intermediate transfer belt is for the superimposition of a first-color toner image or for the superimposition of a last-color toner image.

Case (I) is the case where the primary transfer process for a first-color toner image is performed while the cleaning blade is in contact with the intermediate transfer belt and where the primary transfer position is located on the loose side.

In this case, the size of the first-color toner image at the primary transfer position is $((1-\epsilon 2)/(1+\epsilon 1))$ times that of an image formed on the photoreceptor due to a change in the intermediate transfer belt speed from Eq. (8). The size of the first-color toner image is multiplied by $(1/(1-\epsilon 2))$ with respect to that of the image being on the loose side while the cleaning blade is in contact with the intermediate transfer belt since the tension changes when the cleaning blade has moved away from the intermediate transfer belt. As a result, when such enlarged first-color toner image is to be superimposed on second-, . . . and last-color toner images (the cleaning blade is away from the intermediate transfer belt while the second-, ... and last-color toner images are being superimposed) at the primary transfer section, the size of the first-color toner image is multiplied by $(1+\epsilon 1)^{-1}=(1-\epsilon 1)$ with respect to that of the first-color toner image formed on the photoreceptor 101. Hence, if it is assumed that the size of the image formed on the photoreceptor in the circumferential direction is L1 (m), then it is understood that the first-color toner image is reduced by a length of $(L1\cdot\epsilon 1)$ (m) with respect to those of the respective second-, . . . and last-color toner images during the superimposing operation in the primary transfer process.

Case (II) is the case where the primary transfer process for a first-color toner image is performed while the cleaning blade is in contact with the intermediate transfer belt and where the primary transfer position is located on the tense side In this case, the first-color toner image is transferred from the toner image on the photoreceptor in equal size. Since the length of the tense side is reduced at the time the cleaning blade has moved away from the intermediate transfer belt, the size of the first-color toner image is multiplied by $(1/(1+\epsilon 1))$ with respect to that of the image being on the tense side while the cleaning blade is in contact with the intermediate transfer belt. Hence, if it is assumed that the size of the image formed on the photoreceptor in the circumferential direction is L1, the first-color toner image is reduced by a length of $(L1\cdot\epsilon 1)$ (m) with respect to those of the respective second-, . . . and last-color toner images during the superimposing operation in the primary transfer process.

Case (III) is the case where the primary transfer process for a last-color toner image is performed while the cleaning blade is in contact with the intermediate transfer belt and where the primary transfer position is located on the loose side In this case, the size of the images superimposed on the intermediate transfer belt is multiplied by $(1-\epsilon 2)$ on the loose side when the cleaning blade comes in contact with the intermediate transfer belt. The speed at which such images pass through the primary transfer section becomes $((1-\epsilon 2)/(1+\epsilon 1))$ times from Eq. (8). Therefore, the size of the images already superimposed on the intermediate transfer belt at the primary transfer position is multiplied by $(1+\epsilon 1)$ with respect to that of the image formed on the photoreceptor. Hence, if it is assumed that the size of the image formed on the photoreceptor in the circumferential direction is L1, the size of the last-color toner image is reduced by $(L1\cdot\epsilon 1)$ with respect to those of the other color toner images during the superimposing operation in the primary transfer process.

Case (IV) is the case where the primary transfer process for a last-color toner image is performed while the cleaning blade is in contact with the intermediate transfer belt and where the primary transfer position is located on the tense side In this case, the size of the images superimposed on the intermediate transfer belt is multiplied by $(1+\epsilon 1)$ at the primary transfer section. Further, the speed at which the last-color toner image passes through the primary transfer section remains unchanged by the cleaning blade having come in contact with the intermediate transfer belt from Eq. (7). Therefore, if it is assumed that the size of the image formed on the photoreceptor in the circumferential direction is L1 as described above, the size of the last-color toner image is reduced by a length of $(L1\cdot\epsilon 1)$ with respect to those of the other color toner images during the superimposing operation in the primary transfer process.

As is understood from the above, the displacements caused by the cleaning blade having come in contact with the intermediate transfer belt in superimposing the toner images for the primary transfer process are in proportion to the strain $\epsilon 1$ on the tense side of the intermediate transfer belt. Hence, in order to keep the displacements caused by the superimposition of color toner images within a prescribed range, what one must do is to adjust the strain $\epsilon 1$.

A displacement larger than a single image-recording dot caused during the operation of superimposing one color toner image upon another color toner image greatly impairs the quality of a produced image. If it is assumed that the length of a transfer medium in the circumferential direction is L0 (m) and that the width of a single image-recording dot in the circumferential direction is ld (m), then the following condition must be satisfied so that no displacement equal to or larger than a single image-recording dot will be caused during the operation of superimposing one color toner image upon another.

$$L0\cdot\epsilon 1<ld \qquad \text{Eq. (9)}$$

The aforementioned condition can be expressed in terms of a ratio of the length la on the loose side of the intermediate transfer belt to the circumferential length of the intermediate transfer belt as follows.

$$la/l<ld\cdot E\cdot t/(L0\cdot\mu\cdot n) \qquad \text{Eq. (10)}$$

When the intermediate transfer belt position is related to the drive roller position and the cleaning blade position in this way, an output image almost free from transfer displacements can be obtained. The foregoing describes the method of preventing transfer displacement, which is the first aspect of the invention.

By the way, the tension (per unit length in the axial direction) on the loose side expressed in Eq. (4) is not allowed to take a negative value. If the tension takes a negative value, the intermediate transfer belt slackens on the loose side, which in turn does not transmit the drive force by the drive roller well, thus causing a slippage between the drive roller and the intermediate transfer belt. As a result, the intermediate transfer belt travel speed fluctuates so largely at both the primary transfer section and the secondary transfer section that an output image becomes distorted. For overcoming this problem, a condition to be satisfied by the length la on the loose side is obtained from Eq. (4).

$$la/l>(\mu\cdot n-\sigma 0)/(\mu\cdot n) \qquad \text{Eq. (11)}$$

From the condition expressed by Eq. (11) and the condition to prevent transfer displacement expressed by Eq. (10), the tension (per unit length in the axial direction) σ0 to be applied to the intermediate transfer belt while the cleaning blade is away from the intermediate transfer belt must satisfy the following condition.

$$\sigma 0 > \mu \cdot n - 1d \cdot E \cdot t / L0 \qquad \text{Eq. (12)}$$

Hence, if at least a tension within the range defined by Eq. (12) is given to the intermediate transfer belt while the cleaning blade is away from the intermediate transfer belt and if the positional relationship between the drive roller and the cleaning blade is set so as to satisfy Eq. (10), respective color toner images can be superimposed one upon another without causing slippage between the intermediate transfer belt and the drive roller as well as with high accuracy.

The foregoing indicates the conditions to be satisfied by the construction and components to control image defects caused by transfer displacements between one color toner image and another during primary transfer processes. A specific example of a print method that permits high speed printing will be described below with reference to FIGS. 2 and 3.

First, parameter values are presented in Table 1. The intermediate transfer belt 106 is prepared by dispersing carbon in ETFE (ethylene-tetrafluoroethylene copolymer). The image-recording resolution is 600 dpi. The frictional coefficient μ between the cleaning blade 1191 and the intermediate transfer belt 106 and the contact pressure "n" per unit length in the axial direction are measured as a load (μ·n), which is a product, to the intermediate transfer belt 106. The ratio of the length on the loose side to the total circumferential length should be 0.48 or less in order to satisfy Eq. (10). Our construction satisfies the aforementioned conditions as indicated in Table 1.

[TABLE 1]

| | |
|---|---|
| Young's modulus of the intermediate transfer belt E | $1.6 \times 10^8$ (kg/m$^2$) |
| Thickness of the intermediate transfer belt t | $1.5 \times 10^{-4}$ (m) |
| Circumferential length of the transfer medium L0 | $4.2 \times 10^{-1}$ (m) |
| Circumferential length per image-recording dot 1d | $4.2 \times 10^{-5}$ (m) |
| Cleaning blade contact load μ · n | 5.0 (kg/m) |
| Ratio of the length on the loose side la/l | 0.4 (non-dimensional) |

Figure 3:
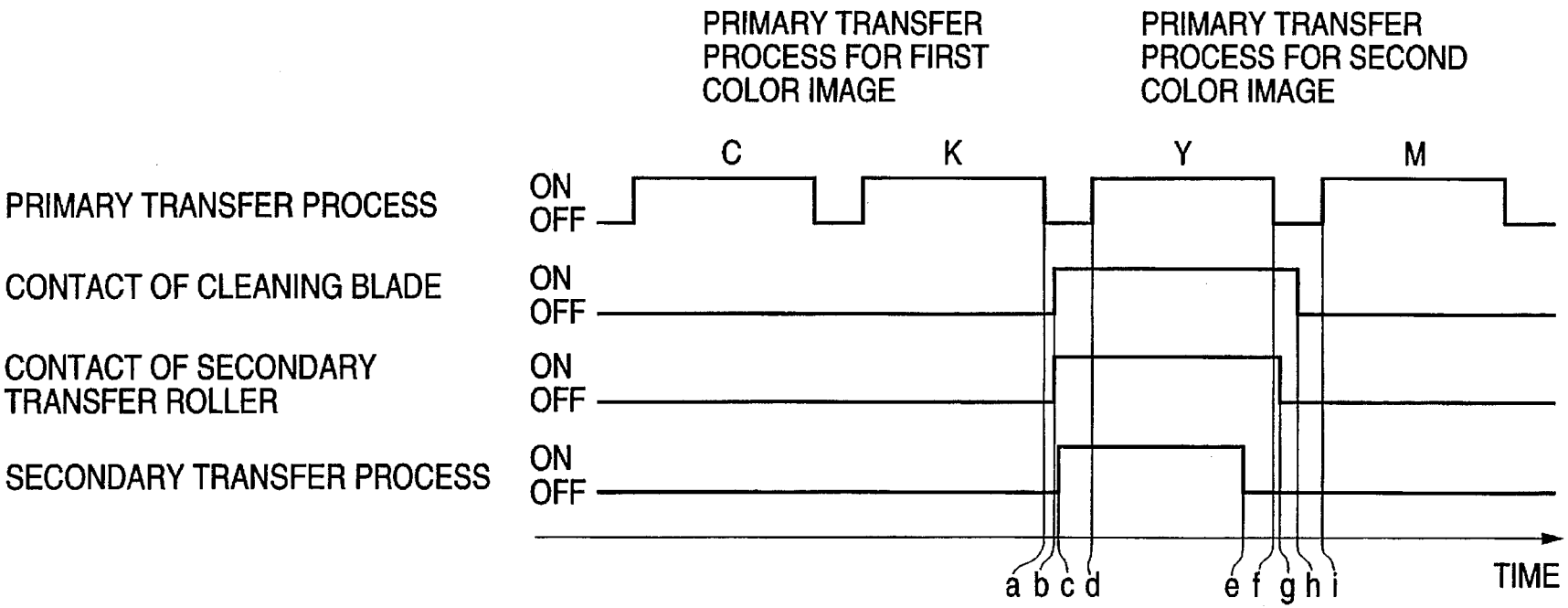
FIG. 3, is a timing chart illustrative of a print process during continuous printing.

The timings of the primary transfer process and cleaning process at the time of continuously printing a color image will be described chronologically with reference to the timing chart shown in FIG. 3. After Y, M, and C toner images have been superimposed one upon another on the intermediate transfer belt 106 at the primary transfer section in order to form a first color image, a K toner image is subjected to the primary transfer process. The primary transfer process of the K toner image completes the primary transfer process for the first color image at timing "a". At timing "b" after the timing "a", both the secondary transfer roller 116 and the cleaning blade 1191 come in contact with the intermediate transfer belt 106.

Then, at timing "c", the first color image that has been superimposed on the intermediate transfer belt 106 reaches the secondary transfer position and is transferred onto the recording medium 113 thereat. The primary transfer process of a Y toner image is started at timing "d" in order to form a second color image. This primary transfer process is carried out with the head end of the Y toner image substantially coinciding with the position at which the head end of the K toner image stayed.

The secondary transfer process for the first color image is completed at timing "e", and the secondary transfer roller 116 and the cleaning blade 1191 move away from the intermediate transfer belt 106 at timing "g" and timing "h", successively. The primary transfer of the Y toner image has been completed at timing "f" that precedes the timing "g". Further, a primary transfer process of a M toner image is started at timing "i", and the C and K toner images are similarly subjected to a primary transfer process to form the second color image.

Since the construction of the apparatus satisfies Eq. (10) as described above, the operation of superimposing one color toner image upon another is performed with high accuracy during the primary transfer process. More specifically, the Y toner image that is subjected to the primary transfer process while the cleaning blade 1191 is in contact with the intermediate transfer belt 106 is superimposed on the toner images of other colors with a predetermined degree of high accuracy.

The primary transfer process of the Y toner image of the second color image is started after a predetermined time has elapsed from the primary transfer start time of the K toner image of the first color image in outputting two color images in this embodiment, the predetermined time being required for the intermediate transfer belt 106 to make a full round. Therefore, wasteful rotation of the intermediate transfer belt 106 entailed in the conventional example can be dispensed with, which in turn allows high speed continuous printing to be implemented.

While the case where the intermediate transfer belt being made of a predetermined material and having a predetermined thickness has been described in the aforementioned embodiment, the invention is not limited thereto. For example, an intermediate transfer belt made of a material containing nylon, PVDF, polycarbonate, and the like as a binder resin may be used. The circumferential length of the recording medium may range from the postcard size to the A3 size. If the frictional coefficient between the cleaning blade and the intermediate transfer belt ranges from 0.5 to 1.2 and the contact load (μ·n) ranges from 3.0 to 8.0 (kg/m), and if an intermediate transfer belt whose Young's modulus ranges from $0.8 \times 10^8$ to $4.0 \times 10^8$ (kg/m$^2$) and whose thickness ranges from 50 to 200 (μm), no displacement is caused between one toner image and another as long as the apparatus is constructed so as to satisfy Eq. (10). Therefore, a color image forming apparatus that can output a high quality image at a high speed can be provided.

As described in the foregoing, the color image forming apparatus of the invention is characterized as controlling a reduction in the accuracy of superimposing one toner image upon another attributable to load fluctuations in the intermediate transfer belt caused by the cleaning blade coming in contact with and moving away from the intermediate transfer belt during primary transfer processes. Therefore, the invention can provide a color image forming apparatus that can output a high quality image at a high speed.

Furthermore, the invention is characterized as controlling a reduction in the accuracy of superimposing one toner image upon another while not only implementing high-speed printing but also eliminating slippage of the belt when the cleaning blade coming in contact with and moving away from the belt. Therefore, the invention can provide a color image forming apparatus that can output a high quality image at a high speed.

What is claimed is:

1. A color image forming apparatus comprising: a first transfer means for sequentially transferring a plurality of toner images developed on a latent image carrying body onto an intermediate transfer belt stretched by a group of support rollers including a drive roller; a second transfer means for collectively transferring the toner images superimposed on the intermediate transfer belt onto a recording medium; and a cleaning means for removing a toner remaining on the intermediate transfer belt, wherein a total circumferential length of the intermediate transfer belt as stretched is l (m);

a Young's modulus and a thickness of the intermediate transfer belt are E (kg/m$^2$) and t (m), respectively;

a frictional coefficient between the cleaning means and the intermediate transfer belt is μ;

a line pressure of a contact load brought about by the cleaning means coming in contact with the intermediate transfer belt is n (kg/m);

a length of the recording medium is L0 (m);

a pitch between dots developed on the latent image carrying body is ld (m); and a ratio (la/l) of a length la (m) to the total circumferential length of the intermediate transfer belt is expressed as follows, the length la extending from a central position of a portion of the intermediate transfer belt that is in contact with the drive roller to a contact position at which the cleaning means is in contact with the intermediate transfer belt in an intermediate transfer belt rotating direction:

$$la/l<ld\cdot E\cdot t/(L0\cdot\mu\cdot n).$$

2. A color image forming apparatus according to claim 1, wherein the group of support rollers including the driver roller supply a tensile load s0 (kg/m) per unit length of the intermediate transfer belt while the cleaning means is away from the intermediate transfer belt is expressed as follows:

$$s0>\mu\cdot n-ld\cdot E\cdot t/L0.$$

3. A color image forming apparatus according to claim 1, wherein a first-color toner image is being transferred onto the intermediate transfer belt while the cleaning means is in contact with the intermediate transfer belt.

4. A color image forming apparatus according to claim 3, wherein the cleaning means comes into contact with the intermediate transfer belt at a timing after the last-color toner image is transferred and before a first-color toner image of the subsequent printing starts being transfered, and the cleaning means moves away from the intermediate transfer belt at a timing after the first color toner image is transferred and before the subsequent second-color toner image starts being transferred.

5. A color image forming apparatus according to claim 1, wherein a last-color toner image is being transferred onto the intermediate transfer belt while the cleaning means is in contact with the intermediate transfer belt.

* * * * *